US005333574A

United States Patent [19]

Brady et al.

[11] Patent Number: 5,333,574

[45] Date of Patent: Aug. 2, 1994

[54] COMPACT BOILER HAVING LOW NOX EMISSIONS

[75] Inventors: Robert T. Brady, Elmhurst; Joseph H. Werling, Mundelein, both of Ill.

[73] Assignee: Mark IV Transportation Products Corporation, Niles, Ill.

[21] Appl. No.: 972,358

[22] Filed: Nov. 5, 1992

Related U.S. Application Data

[63] Continuation-in-part of Ser. No. 760,023, Sep. 11, 1991, Pat. No. 5,259,342.

[51] Int. Cl.[5] ..... F22B 23/06

[52] U.S. Cl. ..... 122/367.1; 110/263; 110/264

[58] Field of Search ..... 110/261, 263, 264; 122/367.1

[56] References Cited

U.S. PATENT DOCUMENTS

| | | | |
|---|---|---|---|
| 4,249,470 | 2/1981 | Vatsky | 110/232 |
| 4,351,251 | 9/1982 | Brashears | 110/263 |
| 4,367,686 | 1/1983 | Adrian | 110/264 |
| 4,438,707 | 3/1984 | Delaplace et al. | 110/263 |
| 4,545,307 | 10/1985 | Morita et al. | 110/263 |
| 4,838,185 | 6/1989 | Flament | 110/263 |

*Primary Examiner*—Henry C. Yuen
*Attorney, Agent, or Firm*—Francis J. Lidd

[57] ABSTRACT

Method and apparatus for reducing the NOX levels in stack emissions of compact boilers and fluid heaters through selective injection of exhaust flue gases into the combustion process. Flue gas injection into the primary and secondary air of the burner along with flue gas injection directly into the combustion process is utilized. Injection of generated steam from a compact boiler, selectively injected into the combustion process is also provided.

17 Claims, 8 Drawing Sheets

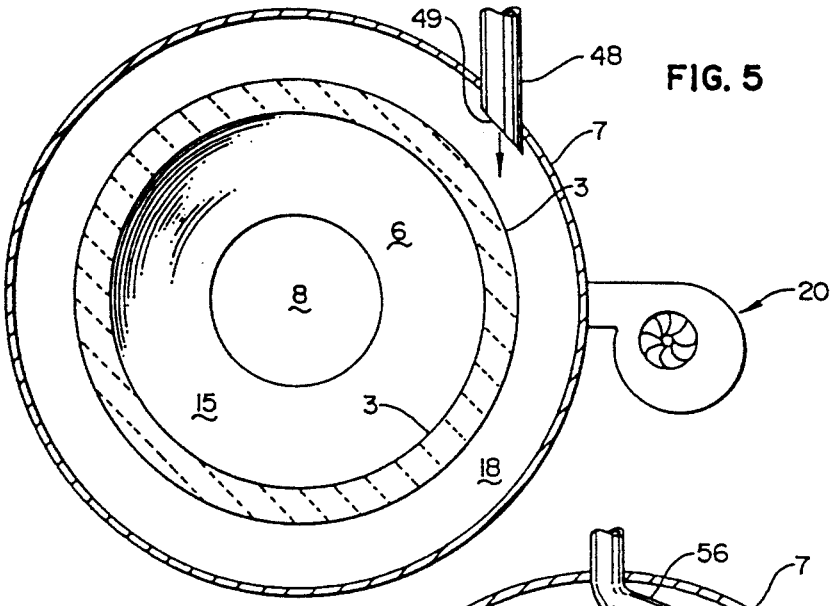
FIG. 5
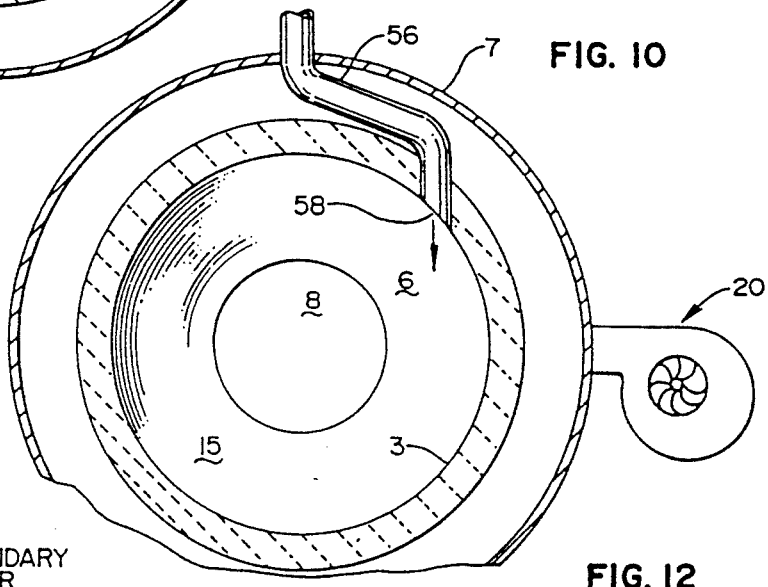
FIG. 10
FIG. 11
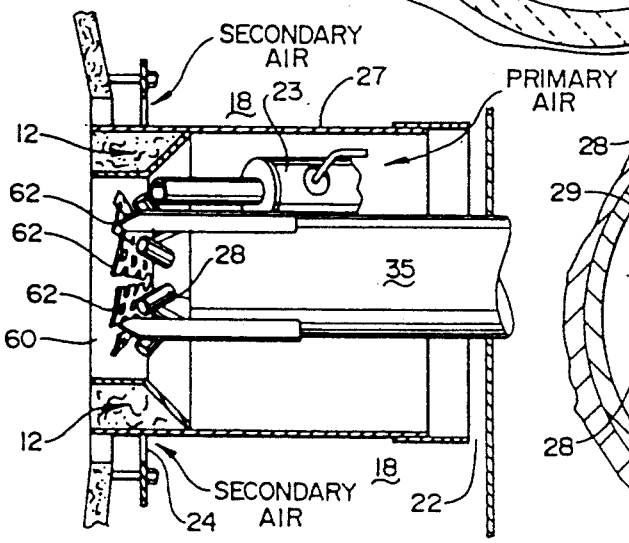
FIG. 12
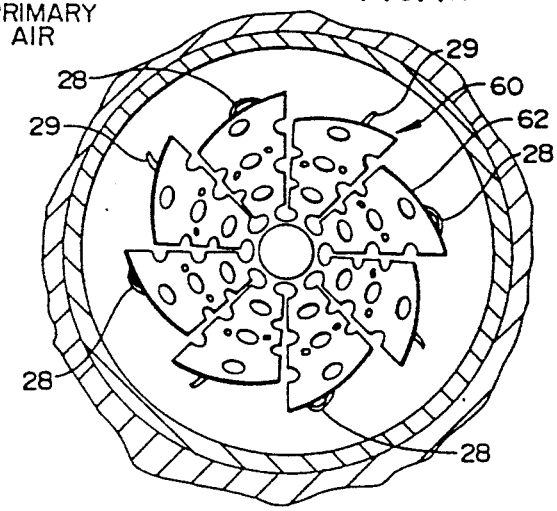

FIG. 6
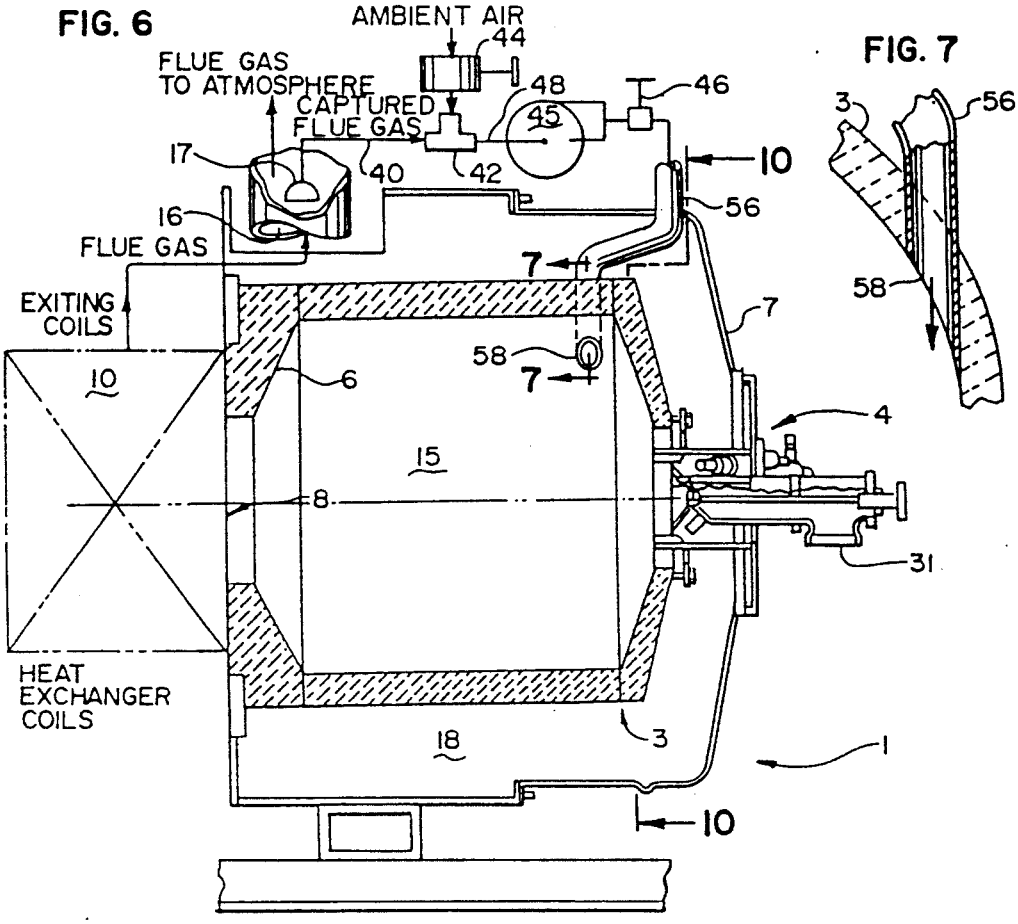
FIG. 7
FIG. 8
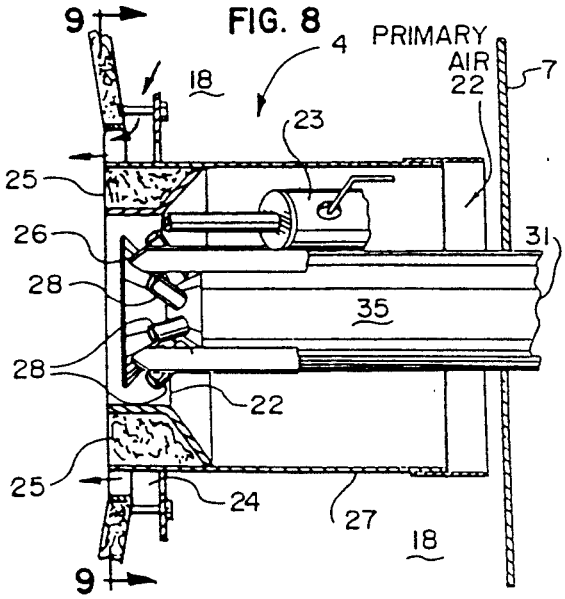
FIG. 9
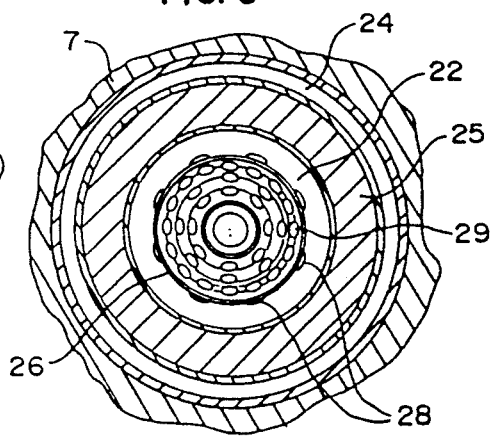

100
75
50
25
NOx CONTENT IN % OF MAXIMUM
(MIN)
1
2
3
4
5
6
7
8
9
(MAX)
B
BOILER FIRING RATE

FROM STEAM OUTLET 19
64

AMBIENT AIR
44
FLUE GAS
TO ATMOSPHERE
43
CAPTURED
FLUE GAS
45
42
46
FLUE
GAS
X1
17
48
7
FLUE GAS
EXITING
COILS
49
63
4
10
6
15
61
X1
8
31
GASEOUS
FUEL
30
52
18
3

18

PRIMARY
4 AIR
7
18
3
SECONDARY
AIR
65
STEAM
25
23
28
31
26
35
28
28
22
24
FLUE
GAS
SECONDARY
AIR
27
18
30
18

22
24
7
25
26
28
29

COMPACT BOILER HAVING LOW NOX EMISSIONS

CROSS REFERENCE TO RELATED APPLICATIONS

This application is a continuation-in-part of copending application Ser. No. 07/760,023, filed on Sep. 11, 1991, U.S. Pat. 5,259,342, the specification of which is incorporated herein by reference.

BACKGROUND OF THE INVENTION

This invention relates generally to combustion of gaseous fuels wherein the NOX content in products of combustion or flue gases are reduced to acceptable levels. More particularly, this invention relates to low NOX combustion systems for gaseous fuel fired compact boilers and similarly fired fluid heating devices.

In the above-mentioned copending application, a system of controlling flue gas NOX content through controlling the ratios of injected flue gas, and ambient air, into the primary combustion air. In that application the flue gas is scavenged or intercepted in the boiler exhaust through the use of a novel bell mouthed duct. Final control of the NOX boiler outlet gas emissions is achieved through sensing low NOX level downstream of the flue gas tap.

Although the above-mentioned system is creditable, applicants in continuing investigation have discovered additional methods for reducing NOX, particularly in the "compact" boiler designs. The invention disclosed herein provides a method for reducing NOX in boiler stack emissions that is less complex, easier to adjust and is lower in cost than earlier systems.

Therefore, it is an object of this invention to provide a method and apparatus for reducing the NOX level in compact boiler stack emissions, It is an additional object of this invention to provide a method and apparatus for reducing compact boiler NOX levels in stack emissions through controlling flue gas injection into the primary and secondary air inputs to the boiler or heater.

It is another object of this invention to reduce the NOX content of compact boiler emissions through control of mixed tertiary air and flue gas injection into the boiler combustion chamber.

SUMMARY OF THE INVENTION

The method and apparatus disclosed herein utilizes a standard compact boiler burner and combustion system. Flue gas or combustion products exiting the heat exchange portion of a compact boiler is mixed with predetermined quantities of ambient or combustion air, and injected into the combustion process through use of a flue gas blower Apportioned quantities of flue gas, ambient air, and mixtures of these are injected into the boiler combustion process.

In a first embodiment, a flue gas/ambient air mixture exiting the flue gas blower is injected in controlled amounts into the boiler combustion air plenum, and the burner primary air channel.

In an alternate embodiment, the mixture of flue gas and ambient air exiting a flue gas blower is injected directly into the combustion chamber of the compact boiler such that mixing of the injected flue gas and the ongoing combustion process is achieved.

An additional improvement utilized in NOX reduction includes improved fuel/air mixing at the burner outlet.

BRIEF DESCRIPTION OF THE DRAWINGS

FIG. 5 is a section along the lines of 5—5 of FIG. 2, particularly showing the location of flue gas injection into the combustion air plenum and location of the primary combustion air blower.

FIG. 6 is a diagrammatic semi-pictorial representation of an alternate embodiment of the invention, particularly showing flue gas recovery, and flue gas injection into the combustion chamber of the boiler.

FIG. 7 is a partial section through the line 7—7 of FIG. 6 particularly showing the structure used to inject flue gas into the boiler combustion chamber.

FIG. 8 is an enlarged section through the burner of FIG. 6, particularly showing the flame holding, flame spreading cone, gaseous flue nozzles, and annular secondary air ports.

FIG. 9 is a section through lines 9—9 of FIG. 8 showing the conical flame stabilizing/flame holder cone of the burner and gaseous fuel nozzles.

FIG. 10 is a section along the lines 10—10 of FIG. 6, particularly showing the location and configuration of the flue gas injection duct and its entry orifice in the inner periphery of the boiler refractory combustion chamber.

FIG. 11 is a cross sectional showing an alternate embodiment of the burner of FIGS. 2 and 7, particularly showing a modified flame spinning/spreading/-flame holding cone of the invention.

FIG. 12 is a section along the lines 12—12 of FIG. 11, particularly showing details of the modified flame spreading/holding cone of the invention in its relationship to the gaseous fuel nozzles.

While the flue gas recirculated combustion system of the invention disclosed herein will be described in connection with certain preferred embodiments and methods, it will be understood that it is not intended to limit the apparatus and system disclosed to that embodiment or method. On the contrary, it is intended to cover all alternatives, modifications and equivalents as may be included within the spirit and scope of recirculated flue gas injection into combustion systems of compact boilers as defined by the appended claims.

DETAILED DESCRIPTION OF THE INVENTION

As the invention disclosed herein is primarily concerned with boilers of the compact variety having characteristics distinctly different from conventional steam boilers and/or fluid heaters, the following general description will address operation of the boiler in conjunction with the flue gas recirculating system. Subsequent description will, in much greater detail, discuss the operation and structure of applicants' novel flue gas recirculating system. However, to impart a basic understanding of compact boiler operation of the type disclosed herein, it is necessary to refer to FIG. 1. It should be noted that the portions of the boiler closely associated with the invention disclosed herein will be depicted by symbols referred to in the discussion. Other elements largely included to complete applicants disclosure of the compact boiler of the invention will be described by written legends as shown. The terminology of these written legends is, as those skilled in the art will readily recognize, composed of terminology of long standing and wide acceptability in the boiler and liquid heater arts.

An additional and widespread use of the heater configuration disclosed is supplying heat to remote locations by circulating high temperature fluids. The heat transfer fluids utilized have boiling temperatures as high as 600° F. with relatively low vapor pressures. In operation, these units have no appreciable fluid vaporization, and are termed "liquid phase" heaters.

Figure 1:
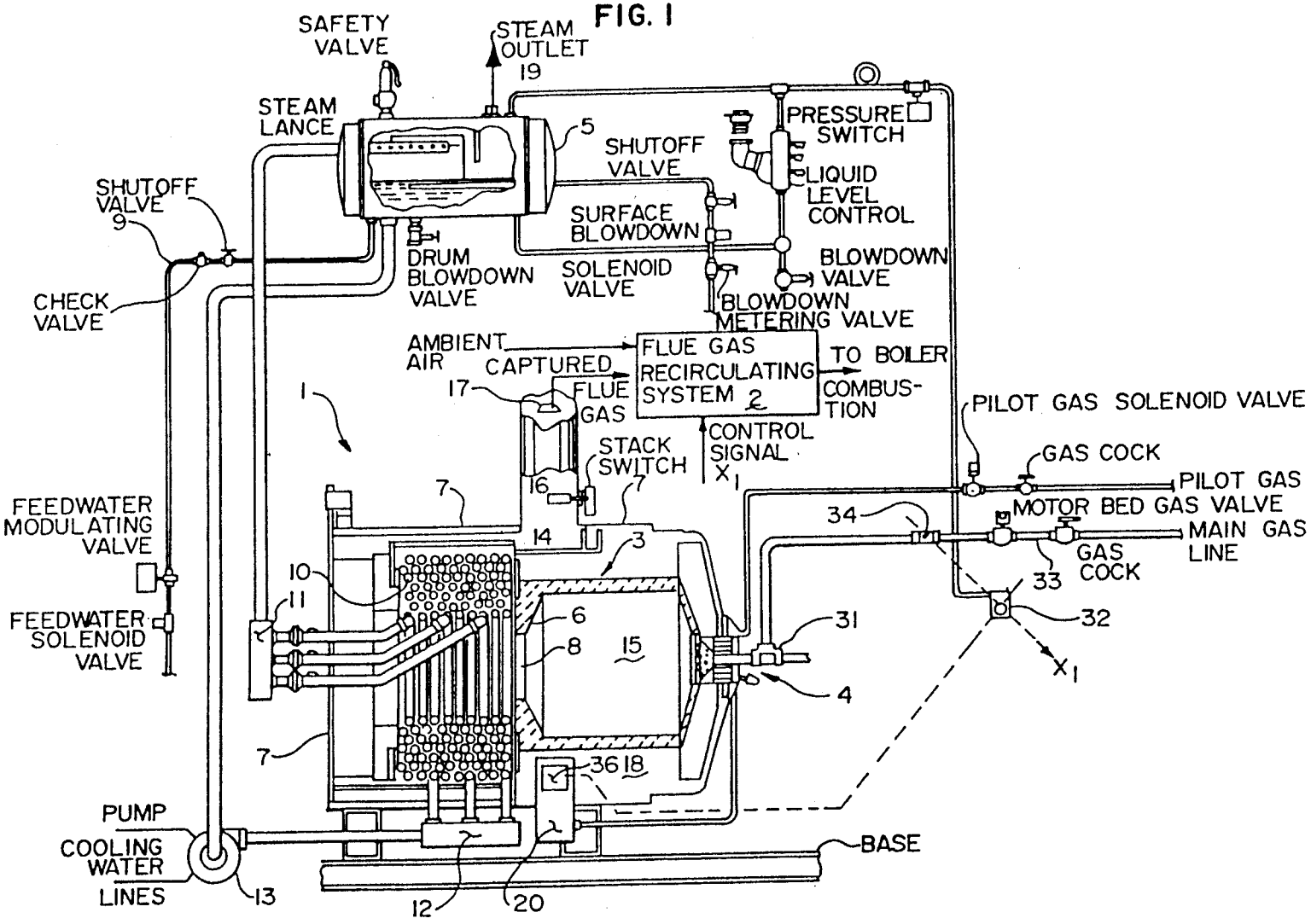
FIG. 1 is a semi-schematic and diagrammatical section view of a "typical" compact boiler of the invention, in particular, shown are connections to fuel and feed water inputs, combustion gas outlets and a view of the entire burner-combustion chamber structure juxtaposed in a heat transfer relationship with the steam generating or fluid heating coils. Also shown are the outlet steam pressure control, combustion air, and fuel inlet valves.

Therefore, in particular reference to FIG. 1, there is shown a boiler assembly 1 having an outer shell 7 containing a refractory combustion chamber 3 having an inner volume 15 and, at its inlet end, a burner assembly 4, and, at its outlet end, a combustion choke 6 and outlet 8. In fluid communication with the combustion outlet 8 is a coil tube bank 10 through which combustion gases generated in the chamber 15 flow outward into the combustion gas plenum 14 and from there to the atmosphere through the boiler outlet or stack 16. Located in the stack 16 is a stack gas capture device or scoop 17, and duct 40 which supply flue gas to the recirculating system 2. As discussed above, this system 2 comprises a major portion of the invention disclosed herein and will be discussed in much greater detail. Also included in the boiler operation is a steam drum 5 supplied with feed water by a water supply inlet 9. Water level in the drum is maintained as shown by a water level control. Feed water, maintained at a typical level as shown is recirculated from the steam drum 5 by recirculating pump 13 through coil bank inlet manifold 12. After feed water exits the manifold 12 and passes through tube bank 10, now heated to a predetermined temperature and pressure, the water exits the coil banks through manifold 11, passes into the steam drum and is sprayed via a steam lance into the drums as shown. Since the pumped water exiting the steam lance is above its saturation temperature, much of it flashes into steam which is delivered to an associated system having steam demand via the steam outlet as shown. Return water enters the drum and is recirculated via the pump 13.

Combustion control is accomplished through the use of a steam pressure actuator 32 operating in conjunction with variable gas flow valve 34 controlling combustion gas flow from supply 33 to burner inlet 31, and further controlling combustion air blower damper control 36. In operation, pressure associated with the steam outlet representing steam demand is applied to the pressure actuator 32 which in turn adjusts the firing rate and combustion air blower in accordance with a predetermined ratio of fuel/air over a predetermined firing range of the unit. Signals representing the particular firing range associated with an additionally particular steam demand are thereby available for operating elements of the flue gas recirculating system which will now be described in detail. Similar control of liquid phase heaters would be related to thermal load reflected in return fluid temperature drop instead of steam pressure.

Figure 2:
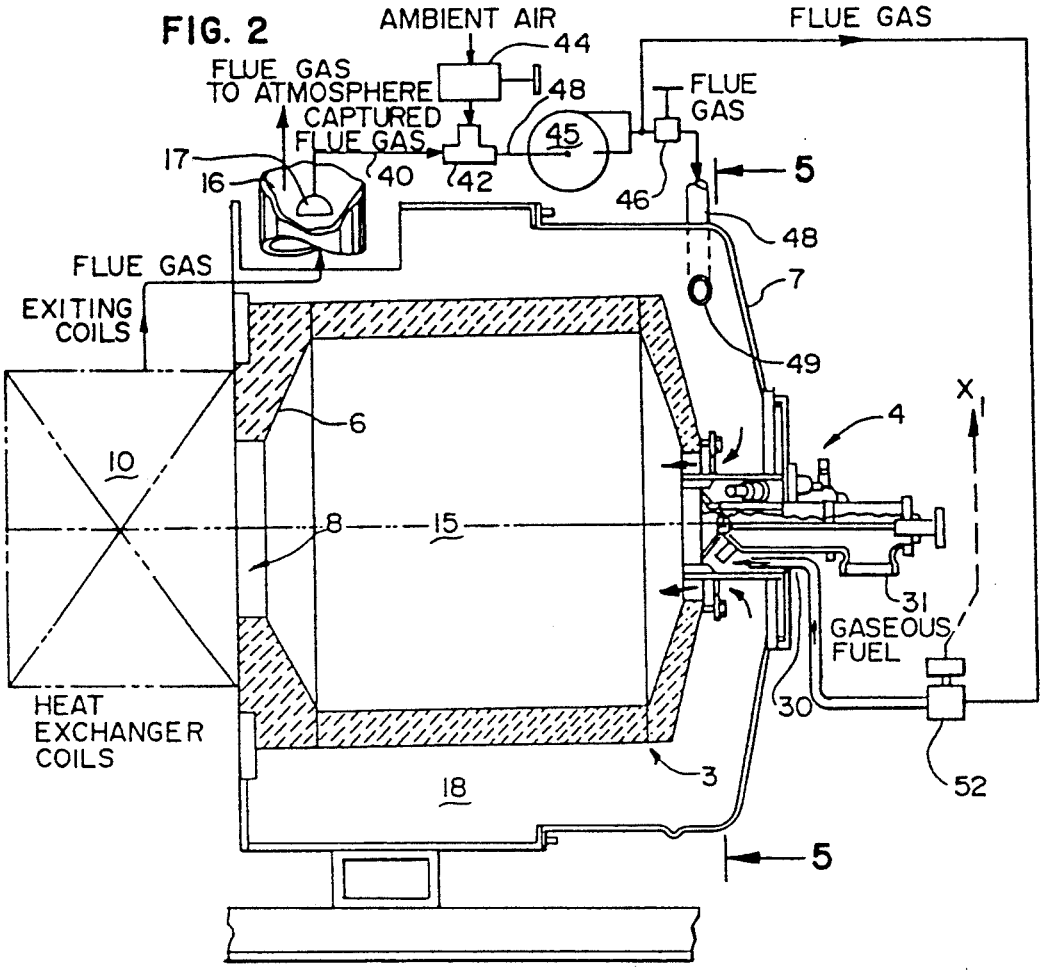
FIG. 2 shows a first embodiment of the invention in diagrammatic, semi-pictorial section, particularly showing the relationship of recirculated flue gas injected into the burner and combustion air plenum. The structural relationship between the boiler combustion chamber and burner are also shown.

In particular reference to FIGS. 2 and 5, a preferred embodiment of the flue gas recirculating system (FGR) 2 of FIG. 1 is shown in detail. As shown in FIG. 2, a portion of the flue gas exiting the heat exchange system 10 via the outlet stack 16 is captured by a scoop 17, carried by duct 40 to tee 42 and further carried by duct 43 to the inlet of flue gas blower 45. The tee 42 combines flue gas with ambient air controlled by valve 44 with flue gas entering the blower 45. Flue gas exiting the blower 45 travels through control valve 46 through injecting duct 48 and enters the compact boiler plenum 18 via flue gas exit orifice 49. Additional amounts of flue gas exiting the blower 45 are carried via duct 50 through control valve 52 and burner inlet duct 50 to the burner outer shell 27 of the burner assembly 4 via inlet port 30. As the burner shell 27 is contained intermediate the boiler outer shell 7 and combustion chamber wall 3 with primary and secondary air ports 22 and 24, respectively, supplied from plenum 18, the flue gas injection via 30 provides a flue gas/primary air mixture within the burner outer shell 27. Also shown within the shell 27 is a pilot assembly 23.

Figure 3:
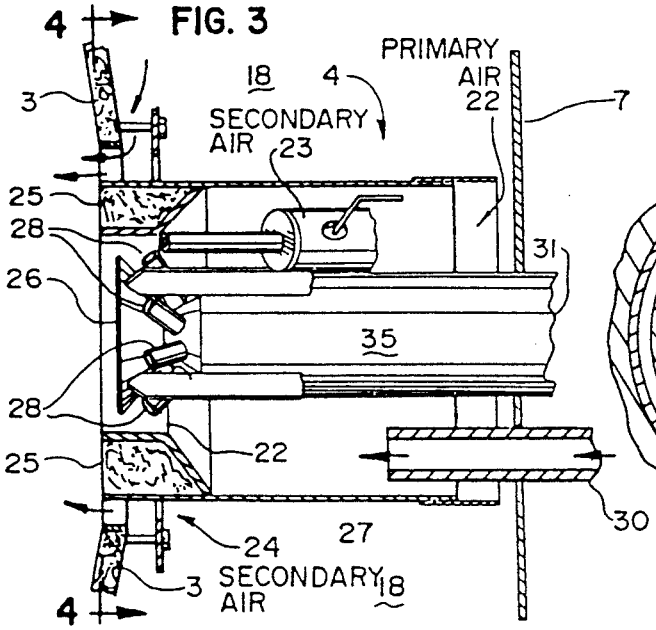
FIG. 3 is an enlarged cross-section of the burner of FIG. 2 including its mounted location internal of the combustion air plenum, and particularly showing the primary air flue gas injection port.
Figure 4:
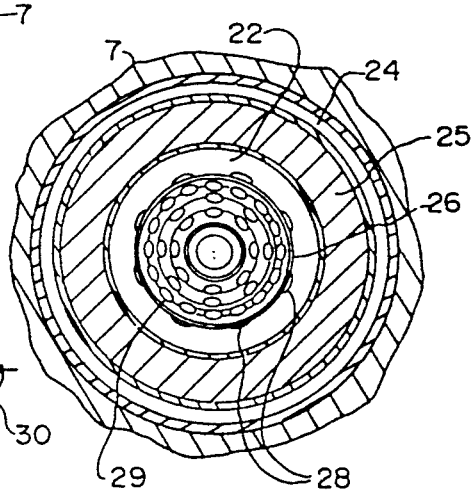
FIG. 4 is a section along the lines of 4—4 of FIG. 3, particularly showing the flame holding cone and gaseous fuel nozzle locations.

Burner assembly 4 further consists of a gas tube 35 fed with gaseous fuel gas via inlet means 31. In continuing reference to FIG. 3 and FIG. 4, annular secondary air inlets 24 are shown. Also shown is a virtual annular primary air inlet orifice 22 defined by mounting the burner end of blast tube 35 within a circular inlet orifice, i.e., defined by an annular flame holder ring 25 including a combustion assembly comprised of a series of gaseous fuel nozzles 28 peripherally radiating from the end of gas tube 35. Also attached to the end of gas tube 35 is a flame spreading conoidal ring member 26. As shown in FIG. 4 the flame spreading member further contains a multiplicity of flame holding orifices 29.

In operation, gaseous fuel entering the burner assembly 4 via inlet 31 exits the combustion end of gas tube 35 via nozzles 28. With the nozzles positioned as shown concentrically mounted within the burner outer shell 27, a mixture of primary air entering orifice 22, and gaseous fuel exiting nozzles 28 are mixed and ignited by the pilot assembly 23. Combustion gases are then propelled into the combustion chamber 5. Secondary air entering combustion chamber 5 contributes to combustion therein. Since flue gas entering the inlet port 30 also mixes with the primary air internal of an annular space defined by the outer surface of gas tube 35 and the inner surface of outer shell 27, flue gas mixing occurs in the combustion process at the point of gaseous fuel entrance into the combustion process.

Figure 15:
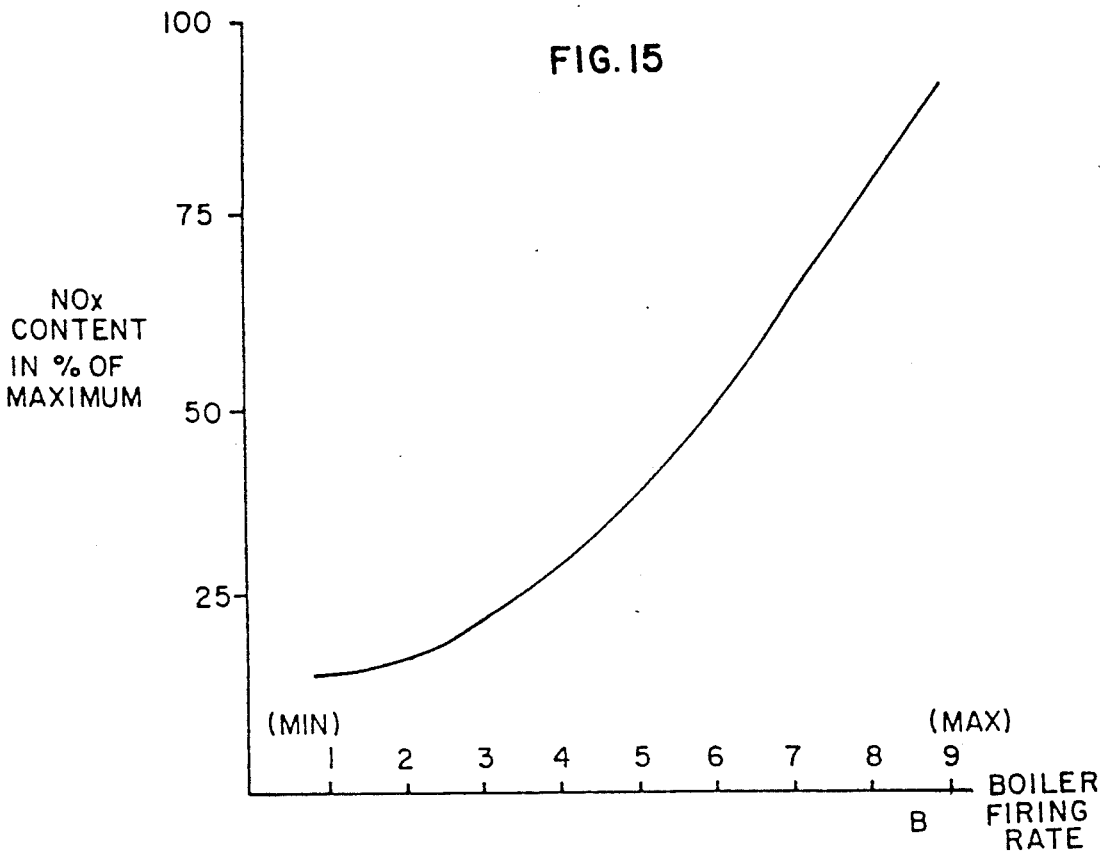
FIG. 15 is a graphical depiction of the boiler emission NOX content utilizing the injection systems of the invention for the entire firing range of the compact boiler disclosed.

Applicants have discovered, as shown in FIG. 15, that injecting properly controlled amounts of flue gas in both the combustion air plenum 18, and simultaneously into the burner primary air mixing annulus 19 provides a substantial reduction in the NOX content of gases exiting the heat exchange section and entering the stack 16.

The essential nature and location of flue gas injection into the combustion air plenum 18 is shown in FIG. 5. As shown, flue gas enters the chamber 18 via duct 48 and orifice 49 flowing tangentially (as shown) in the annular inter-space between the outer surface of chamber 3 and the boiler outer shell 7. Also shown is the approximate location of a combustion air blower 20 mounted so as to inject ambient combustion air into the annular space 18.

Typically, in a compact boiler of the size found to be widely accepted in the marketplace, approximately 22% of the total flue gas stack flow would be recirculated, gas flow apportioned between the burner and combustion plenum approximately 14% and 86%, respectively, of the total. It should be noted that these figures are maximum recirculation at maximum boiler output, the control system utilized in the invention apportions these in varying amounts as determined by the boiler or heater firing rate, which in turn, as indicated earlier, is controlled by the output steam demand or heater thermal load.

An alternate embodiment of the invention is particularly shown in FIG. 6. As in the first embodiment, a controlled amount of flue gas exiting the boiler exhaust stack 16 is carried via ducts 40 and 43, through mixing tee 42, adding ambient air through valve 44, into the inlet of FGR blower 45. However, in a distinct departure from the first embodiment, flue gases exiting the blower 45 pass through the annular combustion air plenum 18 and enter the combustion chamber 15 directly through duct 56 and combustion chamber inlet orifice 58. With reference to FIG. 7, the method of tangentially injecting flue gas into the combustion process is shown by the location of orifice 58 where duct 56 enters the wall of combustion chamber 3.

In FIG. 7, the location of flue gas inlet orifice 58 is shown in section, entering the combustion chamber 15 in a flow pattern tangential to the chamber inner surface, thereby providing improved mixing of recirculated air flue gas mixture now added directly into the combustion process. FIGS. 8 and 9 show in complete detail the burner of the invention as described earlier.

An additional embodiment of the invention disclosed, is shown in FIGS. 11 and 12. With particular reference to FIG. 12, there is shown essentially the burners of FIGS. 3 and 8, however, incorporating an improved flame spinning cone 62. As shown, cone 62 has been reconfigured to provide a plurality of angularly twisted or offset vanes aligned so as to impart a spinning motion into the mixture of gaseous fuel, primary air and flue gas exiting the burner head assembly annular outlet orifice 22. The use of vanes arranged and located as shown further increases the reduction in NOX emissions through improved flue gas fuel and air mixing prior to entering the combustion process.

Figure 13:
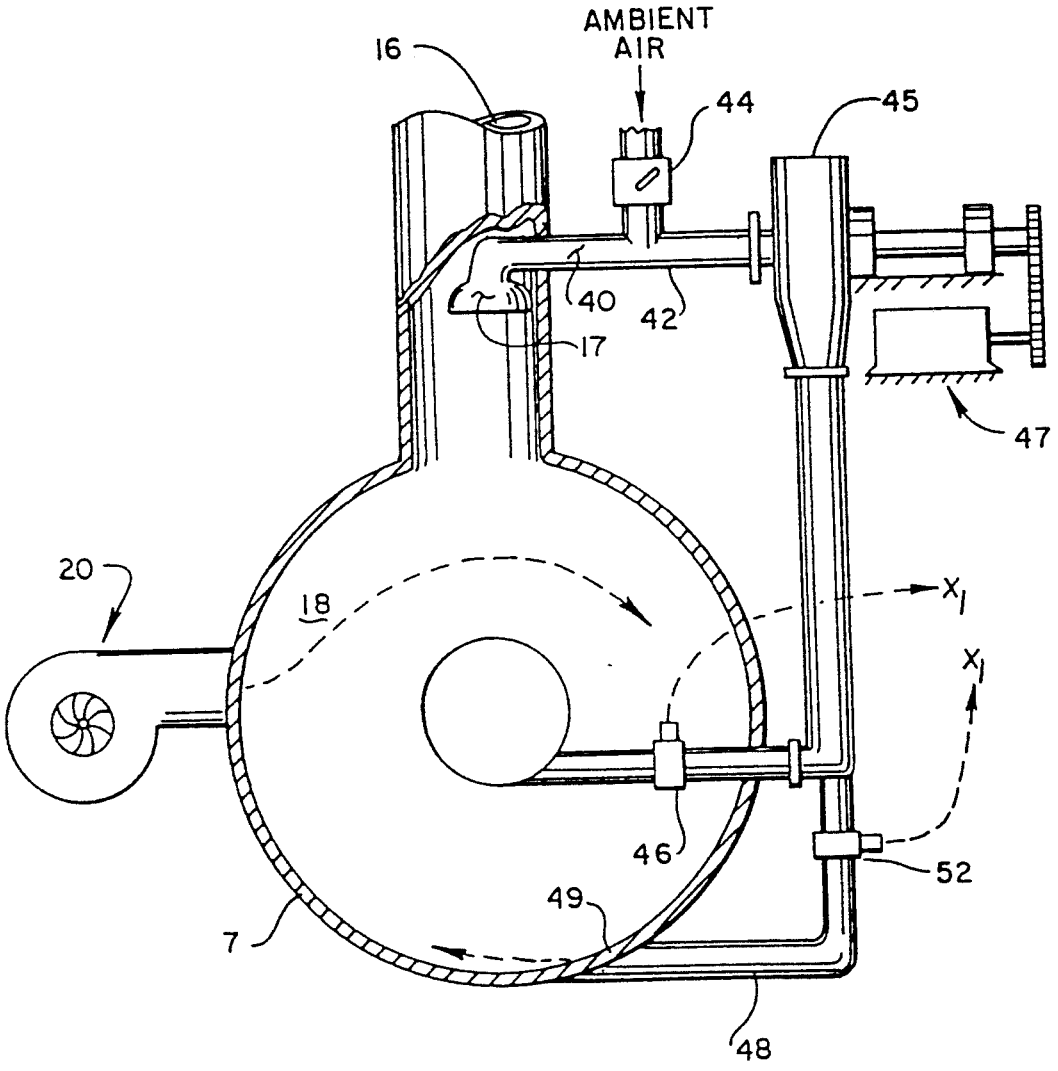
FIG. 13 is a semi-diagrammatical, semipictorial representation of the flue gas injection system of the boiler shown in FIG. 2, more particularly showing the flue gas scoop and interceptor duct, blower, and location of the blower outlet ducting utilized to control and inject flue gas into the primary burner combustion air and boiler combustion air plenum.

A more detailed depiction of the flue gas recirculating system of the first embodiment is shown in FIG. 13. As shown, combustion air entering the stack 16 and scoop 17 travels through duct 4 where it is mixed with predetermined amounts of ambient air via control valve 44 in mixing tee 42 thereby entering the inlet of blower 45 driven by drive means 47. Flue gas exiting the blower 45 at increased pressure enters the combustor outer shell 27 via control valve 46. Similarly, flue gas flowing through inlet duct 48 is controlled by valve 52. Ambient combustion air is introduced to the plenum 18 by blower 20, as shown.

It should be noted that both control valves 46 and 52 are actuated by delivered steam pressure via actuator 32. With this system, amounts of gaseous fuel, combustion air exiting combustion blower 20, flue gas recirculated through valves 46 and 52 are optimumally proportioned to provide required steam at the boiler outlet 19 while limiting the NOX content over the firing range as shown by FIG. 15.

Figure 14:
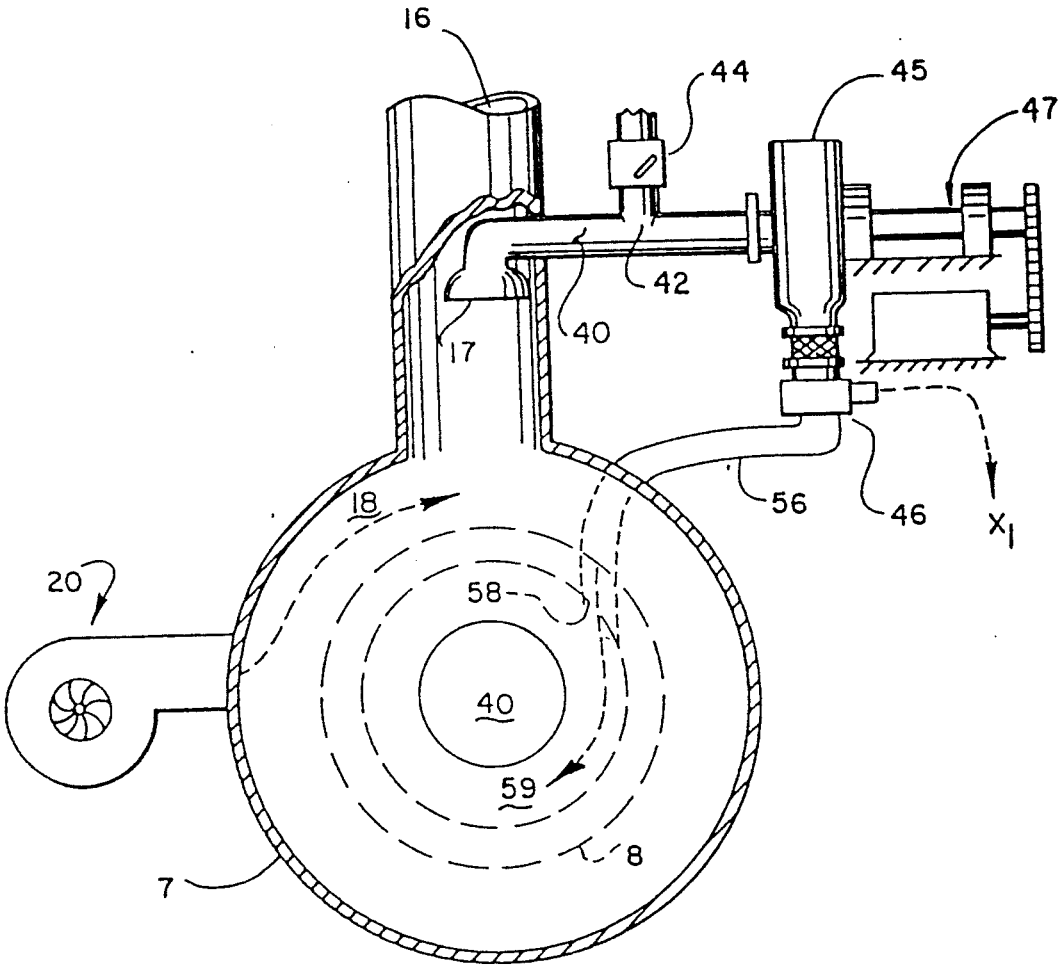
FIG. 14 is a semi-diagrammatical, semipictorial view of the flue gas recirculating system of the invention, similar to that of FIG. 13, however, particularly showing flue gas exiting a flue gas blower and location of flue gas direct injection into the combustion chamber of the boiler.

Similarly, FIG. 14 provides a semi-diagrammatic depiction of the flue gas control system of the first alternate embodiment wherein combustion air exiting blower 20 passes through the annular combustion air plenum 18 defined by the combustion chamber outer surface 3 and the boiler shell 7 as shown. Flue gas captured via scoop 17 in stack 16 is mixed with ambient air controlled by valve 44 at tee 42, and enters the inlet of combustion air blower 45 via duct 40. FGR blower 45 is controlled by a drive assembly 47.

The flue gas/ambient air mixture exits combustion air blower 45 at increased pressure, passes through control valve 46 into duct 56 and is injected directly into the combustion chamber 15 via tangential inlet orifice 58, initiating a flow pattern 59.

Figure 16:
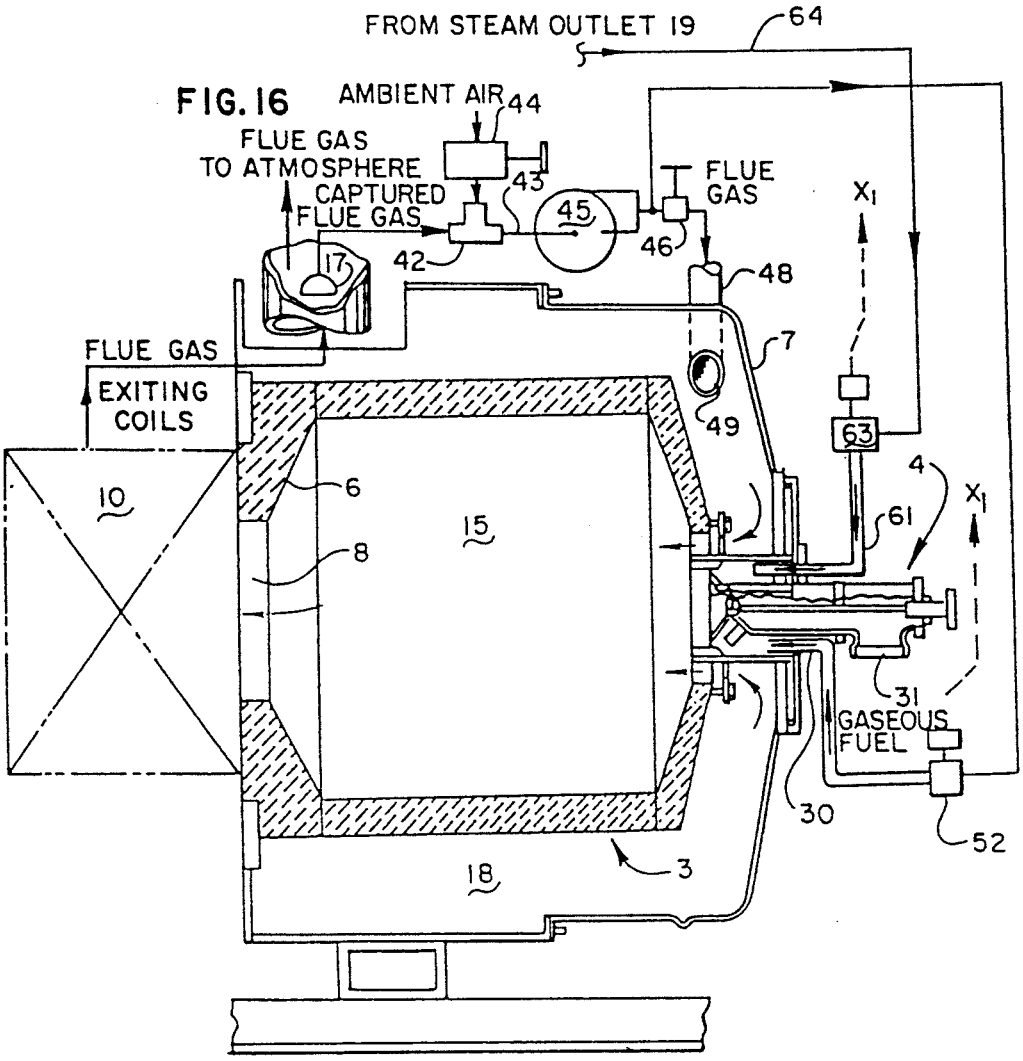
FIG. 16 is a semi-pictorial cross-sectional view of the boiler of the invention similar to FIG. 2, however, particularly showing the use of steam injection into the burner shell.
Figure 17:
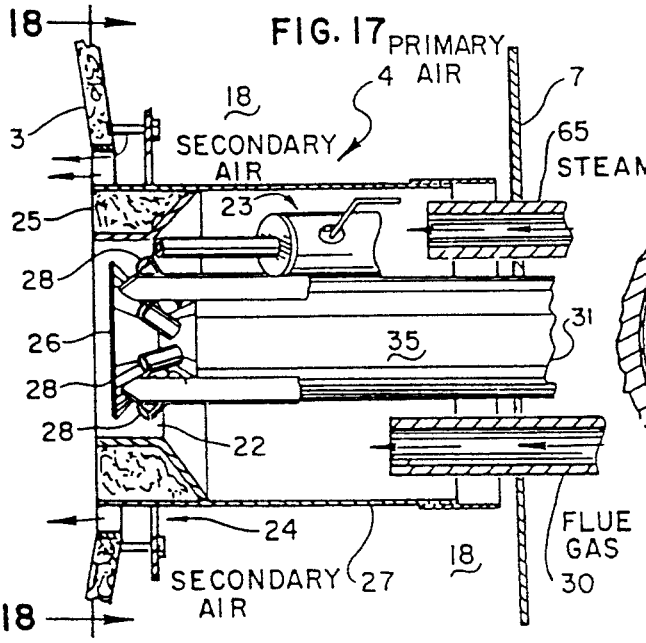
FIG. 17 is an enlarged cross-sectional view of the burner assembly of FIG. 16, particularly showing steam injection into the burner shell.
Figure 18:
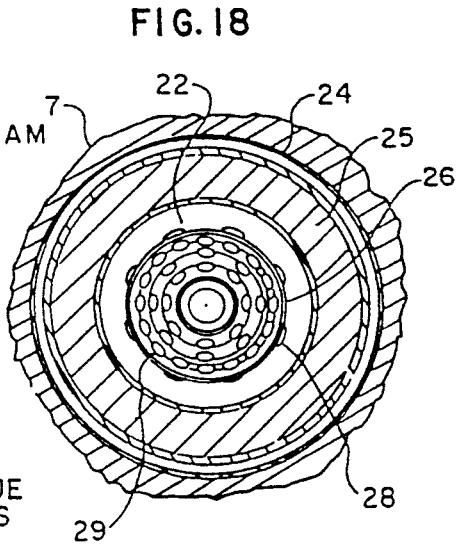
FIG. 18 is a cross-sectional view along the lines 18—18 of FIG. 17 showing additional views of the burner construction.

A further embodiment of the invention is shown on FIGS. 16, 17 and 18. Disclosed in these figures is applicants' further discovery that in the case of a compact steam boiler, injection of boiler output steam from the drum 5 via outlet 19 further reduces the NOX content of the boiler flue gas emitted to the atmosphere.

With particular reference to FIGS. 16 and 17, there is shown a boiler having the flue gas recirculating system of FIG. 2, however, including steam injection at the burner primary air inlet.

As shown, steam from outlet 19 (reference FIG. 1) via steam line 64 passes through control valve 63 and enters the burner via conduit 61. With particular reference to FIG. 17, the controlled steam exiting valve 63 passing through conduit 61 enters the burner shell 27 at the steam injector 65.

In a "typical" steam generator of a popular size and capacity, steam injection as shown comprises approximately 1.5%-2.46% of the total maximum boiler steam delivery to a given load.

As shown in conjunction with flue gas recirculation, applicants submit that utilizing steam injection is, therefore, an important advancement in the art of NOX reduction, particularly for compact boilers of the type disclosed herein.

As indicated above, applicants have discovered that recirculating combustion flue gas by injecting gases at certain heater locations corresponding to critical points in the combustion processes of a compact fluid heater have provided reductions in NOX content of stack gases as required by recent environmental considerations.

Applicants further discovery that injecting properly controlled amounts of steam into the combustion process via the burner primary air is a further low cost, easy to adjust, and effective method of reducing NOX content in the stack emissions of a compact boiler.

The novel and inexpensive approaches disclosed herein are easy to adjust, low cost, and conforms to existing emission regulations with a minimum of boiler redesign.

Thus, it is apparent that there has been provided in accordance with the invention, modifications in a compact boiler resulting in reducing NOX levels in boiler exhaust gases, that fully satisfy the objects, aims and advantages set forth above.

While the flue gas and steam recirculating systems and apparatus disclosed have been described in conjunction with specific embodiments thereof, it is evident that many alternatives, modifications and variations will be apparent to those skilled in the combustion arts and in the light of the foregoing description. Accordingly, it is intended to embrace all such alternatives, modifications, and variations as may fall within the spirit and broad scope of the appended claims.

What is claimed as new and desired to be secured by Letters Patent of the United States are:

1. In combination, a compact fluid heater comprising:
a combustor for generating heat including high temperature combustion products, comprising:
an essentially cylindrical chamber having oppositely disposed ends;
a centrally located vent at one said chamber end;
a burner in the other said chamber end comprising:
an essentially cylindrical outer shell having inlet and outlet ends;
means mounting said shell outlet end in said chamber adjacent said chamber burner end, said mounting means and shell outlet end defining secondary air inlet to said burner;
a gas supply tube coaxially disposed in said shell, said tube having first and second ends, said second tube end adjacent said secondary air inlet;
means supplying gaseous fuel to said first supply tube end;
an annular orifice defined by said shell outlet end and gas supply tube second end;
a plurality of gas ports in said gas supply tube second end, and said orifice, said ports circumferentially disposed in said annular orifice;
means supplying primary combustion air to said outer shell inlet end; and,
means supplying combustion air to said primary and secondary inlets;
a coaxially disposed heat exchanger having internally flowing fluid for absorbing said combustor generated heat by flow of combustion products therethrough, and heating said fluid thereby, said combustion products collected in an outlet;
stack means in fluid communication with said exchanger outlet for exhausting said gases to the atmosphere;
means in said stack means capturing a controlled amount of said exhaust gases;
means injecting said captured gas into said combustor supply means;
means in said supply means, proportioning said captured gas among said primary and secondary combustion air inlets.

2. The fluid heater of claim 1 further comprising:
a spin cone on said tube second end, said cone axially displaced intermediate said ports and shell outlet end, said cone having a plurality of vanes extending from an inner diameter, each vane having an angular deviation from base plane of said cone;
wherein said spin cone imparts a helical trajectory to combusting gaseous fuel, primary air and flue gas passing through said shell outlet end.

3. The fluid heater of claim 2 wherein said deviation is in a range of 25° to 35°.

4. The fluid heater of claim 1 further comprising:
a plurality of gas nozzles extending from said gas supply tube ports, and into said primary air inlet, said nozzles circumferentially disposed in said annular orifice; and,
a spin cone on said tube second end, said cone axially displaced intermediate said nozzles and shell outlet end.

5. In combination, a compact fluid heater comprising:
a combustor for generating heat including high temperature combustion products, said combustor, having a source of gaseous fuel, and primary and secondary air inlets, comprising:
an essentially cylindrical chamber having oppositely disposed ends;
a centrally located circular vent at one said chamber end;
a burner in the other said chamber end comprising:
an essentially cylindrical outer shell having inlet and outlet ends;
means mounting said shell outlet end in said chamber adjacent said chamber burner end, said mounting means and shell outlet end defining a secondary air inlet to said burner;
a gas supply tube coaxially disposed in said shell, said tube having first and second ends, said second tube end adjacent said secondary air inlet;
means supplying gaseous fuel to said second gas supply tube end;
an annular primary air inlet defined by said shell inlet end and gas supply tube;
a plurality of ports in said gas tube first end;
means supplying combustion air to said primary and secondary air inlets; and,
a coaxially disposed heat exchanger having internally flowing fluid for absorbing said combustor generated heat by flow of combustion products therethrough, and heating said fluid thereby, said combustion products collected in an outlet;
stack means in fluid communication with said exchanger outlet for exhausting said gases to the atmosphere;
means in said stack means capturing a controlled amount of said exhaust gases;

means injecting said captured exhaust gas into said combustion air supply means;

means in said supply means, proportioning said captured gas among said primary and secondary combustion air inlets.

6. In combination, a compact fluid heater comprising:

a combustor for generating heat including high temperature combustion products comprising:

a combustion chamber having inlet and outlets ends for generating high temperature combustion produces from combusting fuel and air therein;

a burner mounted at said chamber inlet end for supplying combusting fuel and air to said chamber comprising:

an essentially cylindrical outer shell having inlet and outlet ends, said outlet end adjacent said combustion chamber inlet;

a burner secondary air inlet defined by said shell outlet and chamber inlet ends;

a gas supply tube coaxially disposed in said shell, said tube having first and second ends, said second tube end adjacent said secondary air inlet;

means supplying gaseous fuel to said first supply tube end;

an annular primary air inlet defined by said shell outlet end and gas supply tube second end;

a plurality of gas ports in said gas supply tube second end, said ports circumferentially disposed in said annular orifice;

means supplying combustion air to said primary and secondary air inlets; and, heat exchange means in fluid communication with said combustion chamber outlet end, said heat exchange means receiving combustion products from said chamber and extracting heat therefrom, said exchanger having an outlet for exhausting said combustion products to the atmosphere;

means capturing a predetermined amount of said combustion products;

means injecting said captured combustion products into said combustion chamber.

7. The fluid heater of claim 6 further comprising:

a spin cone on said tube second end, said cone mounted intermediate said gas ports and shell outlet end; and a serrated conoidal disk having a plurality of vanes extending from an inner diameter, each vane having an angular deviation from the base plane of said cone;

wherein said spin cone imparts a helical trajectory to combusting gaseous fuel and primary mixtures exiting said shell outlet end.

8. The fluid heater of claim 7 wherein said angular deviation is within a range of 25° to 35°.

9. The fluid heater of claim 6 wherein said combustion chamber capturing and injecting means further comprise:

a wall, intermediate said combustion chamber ends, a blower for delivering said captured combustion gases to said chamber;

an orifice in said chamber wall for injecting said combustion products into said chamber;

means conducting said delivered combustion gases to said orifice;

wherein said delivered combustion gases enter said combustion chamber and modify the ongoing combustion process.

10. In combination, a compact steam generator comprising:

a combustor for generating heat including high temperature combustion products, said combustor having a source of gaseous fuel, and supply means for admitting primary and second air, and steam thereto;

means supplying combustion air to said supply means;

a coaxially disposed heat exchanger having internally flowing fluid for absorbing said combustor generated heat by flow of gaseous combustion products therethrough, and generating steam thereby;

means collecting said gaseous combustion products;

stack means in fluid communication with said exchanger collecting means for exhausting said gases to the atmosphere;

means in said stack means capturing a controlled amount of said gases;

means in said heat exchanger for capturing a controlled amount of steam generated therein;

means supplying said captured gas and steam to said supply means; and means in said combustion air and steam supply means proportioning said captured gas and steam among said combustor inlets.

11. The steam generator of claim 10 wherein the combustor further comprises:

an essentially cylindrical combustion chamber having oppositely disposed ends;

a centrally located circular vent at one said chamber end;

a burner in the other said chamber end comprising:

an essentially cylindrical outer shell having inlet and outlet ends;

means mounting said shell outlet end in said chamber adjacent said chamber burner end, said mounting means and shell inlet end defining a secondary combustion air inlet to said burner;

a gas supply tube coaxially disposed in said shell, said tube having first and second ends, said first end adjacent said shell outlet end, and said second tube end adjacent said secondary combustion air inlet;

means supplying gaseous fuel to said first supply tube end;

an annular orifice defined by said shell outlet end and gas supply tube second end;

a plurality of gas ports in said gas supply tube second end, said ports circumferentially disposed in said annular orifice;

means supplying combustion air to said supply means primary and second inlets; and, a spin cone on said tube second end, said cone axially displaced intermediate said nozzles and shell outlet end.

12. The steam generator of claim 11 wherein said spin cone comprises a serrated cone having a plurality of vanes extending from an inner diameter, each vane having an angular deviation from base plane of said cone;

wherein said spin cone imparts a helical trajectory to combusting gaseous fuels, primary air and steam passing through said shell outlet end and into said chamber.

13. The steam generator of claim 12 wherein the serrated cone includes an angular deviation in a range of 25° to 35°.

14. The steam generator of claim 10, wherein said combustor and proportioning means further comprise:

a combustion chamber for generating high temperature combustion gases, said combustion chamber having inlet and outlet ends and a side wall, said side wall defining an inlet orifice, said orifice providing fluid communication through said side wall and into said chamber;

a burner mounted at said chamber inlet end for supplying combusting fuel and air to said chamber;

means fluid communicating said chamber outlet and heat exchanger;

means in said proportioning means for injecting said captured combustion products through said inlet orifice;

wherein proportioned amounts of gaseous combustion products enter said chamber, thereby modifying the ongoing combustion process.

15. The steam generator of claim 14 wherein the combustor further comprises:

a centrally located circular vent in said chamber outlet end;

a burner in the other said chamber end comprising:

an essentially cylindrical outer shell having inlet and outlet ends;

means mounting said shell outlet end in said chamber adjacent said chamber inlet end, said chamber inlet end and shell outlet end defining a secondary air inlet to said burner;

a gas supply tube coaxially disposed in said shell, said tube having first and second ends, said second tube end adjacent said secondary air inlet;

means supplying gaseous fuel to said first supply tube end;

an annular primary air inlet defined by said shell inlet end and gas supply tube second end;

a plurality of gas ports extending from said gas supply tube second end, said nozzles circumferentially disposed in said primary air inlet;

means supplying primary combustion air to said primary and secondary air inlets; and, a spin cone on said tube second end, said cone axially displaced intermediate said ports and shell outlet end.

16. The steam generator of claim 15 wherein said spin cone comprises a serrated cone having a plurality of vanes extending from an inner diameter, each vane having an angular deviation from base plane of said cone;

wherein said spin cone imparts a helical trajectory to combusting gaseous fuels, primary air and steam passing through said shell outlet end and into said chamber.

17. The steam generator of claim 16 wherein the serrated cone includes an angular deviation in a range of 25° to 35°.

* * * * *